US006337967B1

(12) United States Patent
Izumi et al.

(10) Patent No.: US 6,337,967 B1
(45) Date of Patent: Jan. 8, 2002

(54) IMAGE FORMING APPARATUS FOR SUPERPOSING MONOCHROME IMAGES

(75) Inventors: Takao Izumi; Toshihiro Kasai; Masashi Hiroki, all of Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,787

(22) Filed: Sep. 21, 2000

(30) Foreign Application Priority Data

Sep. 24, 1999 (JP) ..... 11-270895

(51) Int. Cl.[7] ..... G03G 15/16
(52) U.S. Cl. ..... 399/297; 399/302; 399/308
(58) Field of Search ..... 399/302, 308, 399/307, 328, 112, 223, 231, 298, 300

(56) References Cited

U.S. PATENT DOCUMENTS

| | | | |
|---|---|---|---|
| 5,666,599 A | 9/1997 | Miyasaka et al. | 399/162 |
| 5,815,775 A | 9/1998 | Miyasaka et al. | 399/162 |
| 6,085,051 A | 7/2000 | Miyasaka et al. | 399/110 |

FOREIGN PATENT DOCUMENTS

| | | | |
|---|---|---|---|
| JP | 62-220977 | | 9/1987 |
| JP | 7-43975 | * | 2/1995 |
| JP | 7-160088 | * | 6/1995 |
| JP | 7-281577 | | 10/1995 |

* cited by examiner

*Primary Examiner*—Quana M. Grainger
(74) *Attorney, Agent, or Firm*—Foley & Lardner

(57) ABSTRACT

A color image forming apparatus according to the invention includes an intermediate transfer member for transferring a color image onto a paper sheet, a second transfer roller capable of directly transferring, onto a paper sheet, a toner image formed on a photosensitive member to transfer a black-and-white image onto a paper sheet, a first transfer roller for transferring, onto a paper sheet, a color image on the intermediate transfer member. Since the process of transferring a black-and-white image onto a paper sheet is separated from the process of transferring a color image from the intermediate transfer member, a black-and-white image can be transferred onto a paper sheet and fixed thereon immediately after development. Thus, the period required for copying a black-and-white image, in particular, the required first copying period of a black-and-white image can be shortened.

19 Claims, 10 Drawing Sheets

IMAGE FORMING APPARATUS FOR SUPERPOSING MONOCHROME IMAGES

CROSS-REFERENCE TO RELATED APPLICATIONS

This application is based upon and claims the benefit of priority from the prior Japanese Patent Application No. 11-270895, filed Sep. 24, 1999, the entire contents of which are incorporated herein by reference.

BACKGROUND OF THE INVENTION

This invention relates to a color image forming apparatus for superposing monochrome images on each other to form a color image.

A color image forming apparatus using an electronic photography system is designed to execute color separation of an original document image into three primary colors, thereby forming four monochrome images (i.e. images of four colors in total) using toners of C (cyan), M (magenta) and Y (yellow), as complementary colors, and K (black) for emphasizing the black, superposing the monochrome color images and transferring them onto an output material (i.e. a sheet of paper). The process of superposing monochrome images can use a method for superposing toner images on an intermediate transfer member and then simultaneously transferring them onto a paper sheet, or a method for directly superposing toner images on a paper sheet.

Japanese Patent Application KOKAI Publication No. 7-281577, for example, discloses the use of such an intermediate transfer member. Specifically, it discloses an example where an intermediate transfer drum 2 is provided below a photosensitive belt 1.

The method using an intermediate transfer member is employed in many color image forming apparatuses. However, the speed of forming a color image is ¼ the speed of forming a black-and-white image. Further, in color image forming apparatuses, the process of temporarily transferring a toner image onto an intermediate transfer member is included even when forming a black-and-white image. Accordingly, the black-and-white image forming speed (copy speed) of color image forming apparatuses is lower than that of black-and-white image forming apparatuses. The problem in copying speed is conspicuous, particularly in the case of the first copying period that is required for copying only one page.

BRIEF SUMMARY OF THE INVENTION

It is the object of the invention to provide a color image forming apparatus capable of forming a black-and-white image at high speed.

According to a first aspect of the invention, there is provided a color image forming apparatus comprising:

a charger unit for charging a photosensitive member;

an exposing unit for forming an electrostatic latent image on the charged photosensitive member;

a developing unit for visualizing the electrostatic latent image formed on the photosensitive member to form a toner image;

a first transfer unit for directly transferring the toner image on the photosensitive member onto an image receiving material;

a second transfer unit including an intermediate transfer member for transferring the toner image, formed on the photosensitive member, onto the intermediate transfer member, and for transferring the toner image, transferred to the intermediate transfer member, onto the image receiving material; and a fixing unit for fixing the toner image on the image receiving material transferred to the image receiving material by the first and second transfer units and held thereon, thereby.

According to a second aspect of the invention, there is provided a color image forming method in a color image forming apparatus includes a charger unit for charging a photosensitive member; an exposing unit for an electrostatic latent image on the charged photosensitive member charged by the charger unit; a developing unit for visualizing the electrostatic latent image formed on the photosensitive member to formed toner image; an intermediate transfer member for holding the toner image formed on the photosensitive member; a first transfer unit for transferring the toner image on the photosensitive member; a second transfer unit for transferring the toner image on the intermediate transfer member; and a fixing unit for fixing the toner image on an image receiving material; comprising steps of:

forming a first image on the photosensitive member;

forming a second image on the photosensitive member;

directly transferring the first image on the image receiving material by using the first transfer unit;

transferring the second image on the intermediate transfer member; and transferring the transferred second image on an image receiving material by using the second transfer unit.

According to a third aspect of the invention, there is provided a color image forming method in a color image forming apparatus includes a charger unit for charging a photosensitive member; an exposing unit for an electrostatic latent image on the charged photosensitive member charged by the charger unit; a developing unit for visualizing the electrostatic latent image formed on the photosensitive member to formed toner image; an intermediate transfer member for holding the toner image formed on the photosensitive member; a first transfer unit for transferring the toner image on the photosensitive member; a second transfer unit for transferring the toner image on the intermediate transfer member; a first image receiving material supply mechanism for supplying an image receiving material to the first transfer unit along first route; a second image receiving material supply mechanism for supplying an image receiving material to the second transfer unit along second route different from the first route; and a fixing unit for fixing the toner image on an image receiving material; comprising steps of:

forming a first image on the photosensitive member;

forming a second image on the photosensitive member;

directly transferring the first image on the image receiving material supplied from the first image receiving material supply mechanism by using the first transfer unit;

transferring the second image on the intermediate transfer member by the voltage between the photosensitive member and the intermediate transfer member; and transferring the transferred second image on the image receiving material supplied from the second image receiving material supply mechanism by using the second transfer unit.

According to a fourth aspect of the invention, there is provided a color image forming method comprising steps of:

forming a first image on a photosensitive member;

forming a second image on the photosensitive member;

directly transferring the first image formed on the photosensitive member on to a first image receiving material;

transferring the second image formed on the photosensitive member on to an intermediate transfer member; and transferring the second image transferred on the intermediate transfer member on to a second image receiving material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Image forming apparatuses according to the embodiments of the invention will be described with reference to the accompanying drawings.

Figure 1:
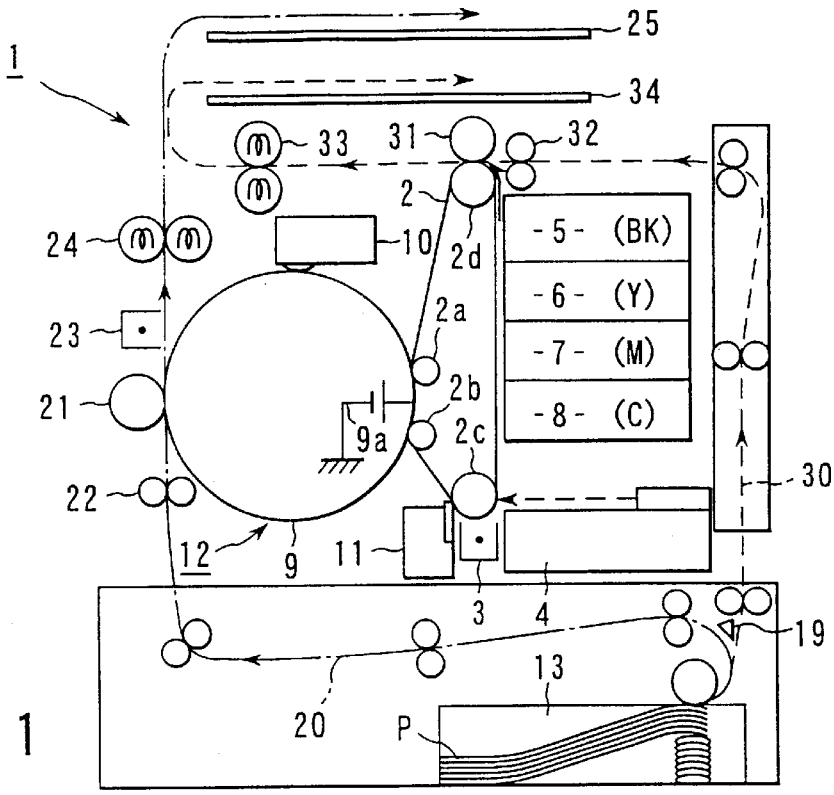
FIG. 1 is a schematic view illustrating a color image forming apparatus according to an embodiment of the invention.

FIG. 1 is a schematic view illustrating a color image forming apparatus according to the invention, which uses an electronic photography process.

As is shown in FIG. 1, a color image forming apparatus 1 includes a photosensitive member 2 in the form of an endless belt, a charger 3 for charging the photosensitive member 2 with a predetermined potential, 4; an exposing unit 4 for forming an electrostatic latent image on the charged photosensitive member 2, first to fourth developing units 5, 6, 7 and 8 for supplying toner to the electrostatic latent image on the photosensitive member 2 to visualize it, an intermediate transfer member 9 for temporarily carrying a toner image formed on the photosensitive member 2 by the developing units 5 to 8, and an image forming section 12 that includes an intermediate transfer member cleaner 10 for cleaning the intermediate transfer member 9, and a cleaning unit 11 for removing toner remaining on the photosensitive member 2.

The photosensitive member 2 is supported, with a predetermined tension, by first and second rollers 2*a* and 2*b* that keep the photosensitive member 2 in tight contact with the outer peripheral surface of the intermediate transfer member 9, and also by third and fourth rollers 2*c* and 2*d* that keep a predetermined space between the photosensitive member 2 and each developing unit. The photosensitive member 2 is rotated at a predetermined speed in a direction, indicated by the arrow in FIG. 1, in accordance with the rotation of a motor (not shown) connected to one of the rollers. The entire length of the photosensitive member 2 is equal to the circumferential length of the intermediate transfer member 9, and is longer than twice the width of a paper sheet of A4 size (i.e. than the length of a paper sheet of A3 size). It will be possible the entire length of the photosensitive member 2 is longer than the circumferential length of intermediate transfer member 9, and possible the entire length of the photosensitive member 2 is shorter than the circumferential length of intermediate transfer member 9. Voltage is supplied to the circumferential portion of the intermediate transfer member 9 by voltage supply 9*a*. The intermediate transfer member 9 is made from hollow aluminium tube covered with rubber member having semi-conductivity and coated with the Teflon (tread name) of the outer surface of the rubber member. The first transfer roller 21 is made from rubber sponge having conductivity.

A paper sheet cassette 13 that contains paper sheets (output material sheets) P having a predetermined size is provided below the image forming section 12.

In the vicinity of the paper sheet cassette 13, there are provided a feed roller 14 for picking up paper sheets in the paper sheet cassette one by one, and a switching mechanism 19 for guiding each picked-up paper sheet toward the photosensitive member 2 or the intermediate transfer member 9.

A first conveyance system 20 for conveying paper sheets P to the intermediate transfer member 9 is provided between the paper sheet cassette 13 and the intermediate transfer member 9. Similarly, a second conveyance system 30 for conveying paper sheets P to the photosensitive member 2 (the fourth roller 2*d*) is provided between the paper sheet cassette 13 and the fourth roller 2*d* that supports the photosensitive member 2.

A first transfer roller 21 for transferring, onto each conveyed paper sheet P, a color toner image formed on the intermediate transfer member 9 is provided at a location in the first conveyance system 20, at which each conveyed paper sheet P contacts the intermediate transfer member 9. A first aligning roller 22 is provided upstream of the first transfer roller 21 (at the paper sheet cassette 13 side) for temporarily stopping each paper sheet P conveyed in the conveyance system 20 to adjust the inclination of each sheet in the transfer direction, and to align the front end of each paper sheet P with the front end of the toner image on the intermediate transfer member 9. Further, downstream of the first transfer roller 21, there are provided a separating unit 23 for applying an AC charge to the intermediate transfer member 9 to separate therefrom each paper sheet P with a color toner image formed thereon, and a first fixing unit 24 for fixing on each paper sheet P the color toner image transferred thereon.

A second transfer roller 31 for transferring, onto each conveyed paper sheet P, a black toner image formed on the photosensitive member 2 is provided at a location in the second conveyance system 30, at which each conveyed paper sheet P contacts the photosensitive member 2. A second aligning roller 32 is provided upstream of the second transfer roller 31 (at the paper sheet cassette 13 side) for temporarily stopping each paper sheet P conveyed in the conveyance system 30 to adjust the inclination of each sheet in the transfer direction, and to align the front end of each paper sheet P with the front end of the toner image on the photosensitive member 2. Further, downstream of the second transfer roller 31, there is provided a second fixing unit 33 for fixing on each paper sheet P the black toner image transferred thereon.

The operation of the color image forming apparatus shown in FIG. 1 will now be described.

When forming a color image, at first, the charger 3 uniformly charges the photosensitive member 2. Subsequently, the exposing unit 4 exposes the photosensitive member 2 to form thereon an electrostatic latent image corresponding to a BK (black) image as a first color image component.

The electrostatic latent image corresponding to the BK image is developed with black toner by the black developing unit (first developing unit) 5, and transferred as a BK image onto the intermediate transfer member 9 by voltage between the photosensitive member 2 and the intermediate transfer member 9. Since, each of the photosensitive member 2 and intermediate transfer member 9 are charged, for example,—(minus) 450 volt and 500 volt.

After transferring the BK image to the intermediate transfer member 9, the photosensitive member 2 is deelectrified by a deelectrifying unit (not shown), whereby toner remaining thereon without being transferred onto the intermediate transfer member 9 is removed by the cleaning unit 11. The removed toner is collected into a used-toner box (not shown).

The charger 3 again charges the photosensitive member 2, and the exposing unit 4 exposes the photosensitive member 2 to thereby form an electrostatic latent image corresponding to a Y (yellow) image as a second color image component.

The electrostatic latent image corresponding to the Y image is developed with yellow toner by the yellow developing unit (second developing unit) 6, and transferred as a Y image onto the intermediate transfer member 9 such that it is superposed upon the previously transferred BK image by voltage between the photosensitive member 2 and the intermediate transfer member 9.

After the photosensitive member 2 is cleaned, it is exposed to form thereon an electrostatic latent image corresponding to an M (magenta) image as a third color image component.

The electrostatic latent image corresponding to the M image is developed with magenta toner by the magenta developing unit (third developing unit) 7, and transferred as an M image onto the intermediate transfer member 9 such that it is superposed upon the previously transferred BK image and Y image by voltage between the photosensitive member 2 and the intermediate transfer member 9.

After the photosensitive member 2 is cleaned, it is exposed to form thereon an electrostatic latent image corresponding to a C (magenta) image as a fourth color image component.

The electrostatic latent image corresponding to the C image is developed with cyan toner by the cyan developing unit (fourth developing unit) 8, and transferred as a C image onto the intermediate transfer member 9 such that it is superposed upon the previously transferred BK image, Y image and M image by voltage between the photosensitive member 2 and the intermediate transfer member 9.

Thus, a color toner image of four colors, including of images sequentially transferred onto the intermediate transfer member 9 and superposed upon each other, is transferred (secondary transfer) by the first transfer roller 21, charged about 1.2 kV, onto each paper sheet P fed from the paper sheet cassette 13 at a predetermined time point and conveyed in the first conveyance system 20 to the first aligning roller 22 via the switching mechanism 14.

Each paper sheet P with the four-color toner image transferred thereon is separated from the intermediate transfer member 9 by the separating unit 23, and conveyed to the first fixing unit 24, where the four-color toner image is fixed thereon. Each paper sheet (output material sheet) P with the color image fixed thereon is discharged to a tray 25.

On the other hand, toner, which could not be transferred to each sheet P and remains on the intermediate transfer member 9, is removed, after the completion of the secondary transfer, by the cleaner 10 to be brought into contact with the intermediate transfer member 9 by a driving mechanism (not shown). It is a matter of course that the intermediate transfer member cleaner 10 is separated from the intermediate transfer member 9 while the four-color toner image is transferred onto the intermediate transfer member 9.

When forming a black-and-white image, the charger 3 uniformly charges the photosensitive member 2, and then the exposing unit 4 exposes the photosensitive member 2 to form thereon an electrostatic latent image corresponding to the black-and-white image.

The latent image corresponding to the black-and-white image and formed on the photosensitive member 2 is developed by the black developing unit (first developing unit) 5, thereby forming a black toner image.

The black toner image on the photosensitive member 2 is transferred by the second transfer roller 31 onto each paper sheet P conveyed in the second conveyance system 30, as a result of switching by the switching mechanism 19, from the paper sheet cassette 13 to the second aligning roller 32. The second transfer roller 31 is usually separated from the photosensitive member 2. Only when forming a black-and-white image, the roller 31 is urged against the fourth roller **2*d* and hence brought into contact with the photosensitive member 2** by a driving mechanism (not shown).

Each paper sheet P with the black-and-white image transferred thereon is conveyed to the second fixing unit 33, where the black-and-white image is fixed thereon. Each sheet (output material sheet) P with the black-and-white image fixed thereon is discharged to a tray 34 via a surface reversing mechanism, which will not be described later in detail.

On the other hand, toner, which could not be transferred to each sheet P and remains on the intermediate transfer member 9, is removed by the cleaning unit 11.

Thus, in the color image forming apparatus 1 having the intermediate transfer member 9, the second conveyance system 30 and the second transfer roller 31, which do not require the secondary transfer using the intermediate transfer member 9, are provided for forming a black (BK) image. Accordingly, a black (BK) image can be output in a short time since a corresponding toner image formed on the photosensitive member 2 is directly transferred onto a paper sheet P.

Figure 2:
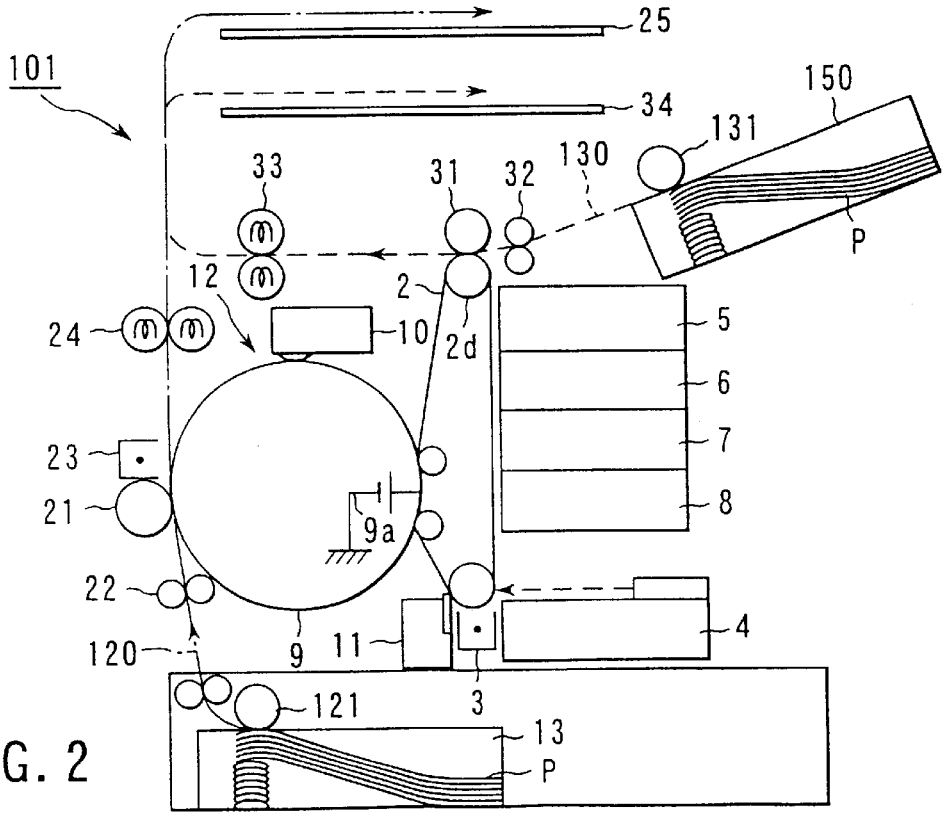
FIG. 2 is a schematic view illustrating a color image forming apparatus according to another embodiment of the invention.

FIG. 2 is a schematic view showing a color image forming apparatus according to another embodiment of the invention. In the color image forming apparatus of FIG. 2, similar elements to those in FIG. 1 are denoted by corresponding reference numerals, and no detailed description will be given thereof.

As shown in FIG. 2, a color image forming apparatus 101 has a photosensitive member 2, a charger 3, an exposing unit 4, first to fourth developing units 5, 6, 7 and 8, an intermediate transfer member 9, an image forming section 12 that includes an intermediate transfer member cleaner 10 and a cleaning unit 11, a first paper sheet cassette 13, a first conveyance system 120, a second conveyance system 130 and a second paper sheet cassette 150.

The first conveyance system 120 includes a first feed roller 121 provided at the intermediate transfer member 9 side of the paper sheet cassette 13 for feeding each paper sheet P toward the intermediate transfer member 9, and can supply the intermediate transfer member 9 with each paper sheet P through a short conveyance path.

The second conveyance system 130 includes a second transfer roller 31 to be opposed to the fourth roller 2*d* of the photosensitive member 2 by a driving mechanism (not shown) only when forming a black-and-white image, an aligning roller 32, a second fixing unit 33 and a second feed roller 131. The system 130 supplies each paper sheet P from the second paper sheet cassette 150 to the transfer roller 31 when forming a black-and-white image.

In the color image forming apparatus 101 shown in FIG. 2, a color image is formed in the same process as in the process shown in FIG. 1. As aforementioned, the second feed roller 131 provided at the paper sheet cassette 13 shortens the time period required for the supply of each paper sheet P to the intermediate transfer member 9, as compared with the structure of FIG. 1.

On the other hand, a black-and-white image formed by developing a black (BK) latent image by the black developing unit 5 is transferred at the transfer roller 31 onto each paper sheet P fed from the second paper sheet cassette 150.

As is evident from FIG. 2, the distance between the second paper sheet cassette 150 and the aligning roller 32 is very short. In the case of the color image forming apparatus of FIG. 1, to form a black-and-white image, it is necessary to feed a paper sheet from the paper sheet cassette 13 to the aligning roller 32 before exposure and development processes. On the other hand, in the structure of FIG. 2, it is not necessary to feed a paper sheet P in advance. Accordingly, this structure is free from a delay in starting exposure due to the time period required for the conveyance of the sheet P to the aligning roller 32.

Thus, the color image forming apparatus of FIG. 2 requires a shorter first copy period when forming a black-and-white image.

Figure 3:
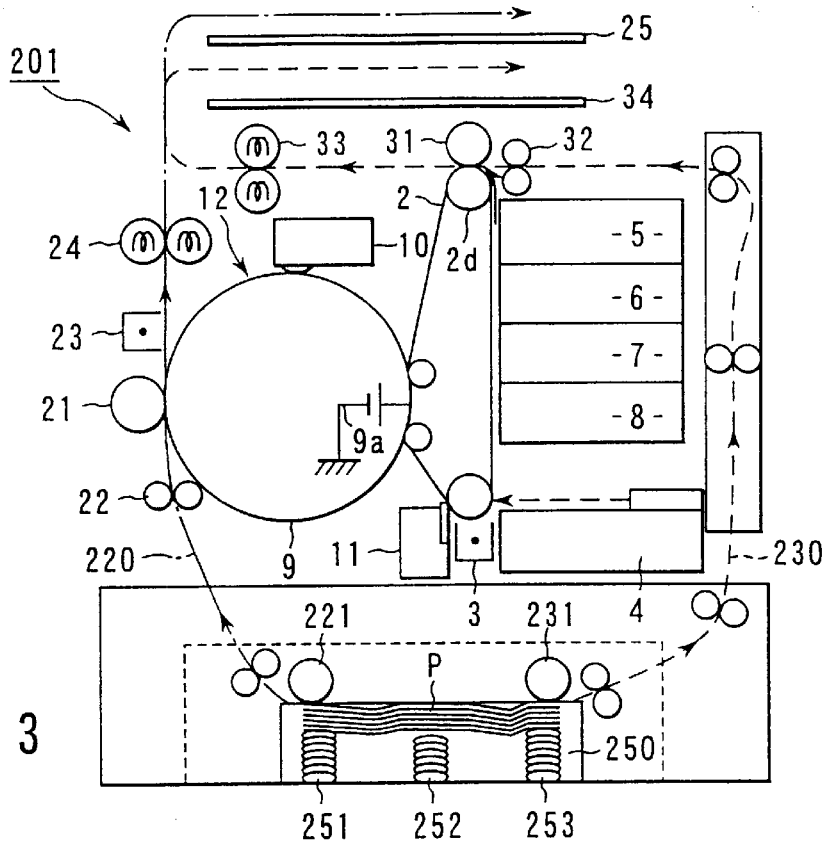
FIG. 3 is a schematic view illustrating a color image forming apparatus according to yet another embodiment of the invention.

FIG. 3 is a schematic view illustrating a color image forming apparatus according to yet another embodiment. In the color image forming apparatus of FIG. 3, similar elements to those in FIG. 1 are denoted by corresponding reference numerals, and no detailed description will be given thereof.

As shown in FIG. 3, a color image forming apparatus 201 includes a photosensitive member 2, a charger 3, an exposing unit 4, first to fourth developing units 5, 6, 7 and 8, an intermediate transfer member 9, an image forming section 12 that includes an intermediate transfer member cleaner 10 and a cleaning unit 11, a first conveyance system 220, a second conveyance system 230 and a paper sheet cassette 250.

The first conveyance system 220 is designed to feed each paper sheet P, contained in the paper sheet cassette 250, to the intermediate transfer member 9. The system 220 can feed each sheet P, using a first feed roller 221, to the intermediate transfer member 9 and the first transfer roller 21 through a short conveyance path.

On the other hand, the second conveyance system 230 is designed to feed each paper sheet P, contained in the paper sheet cassette 250, to the photosensitive member 2, when forming a black-and-white image. The system 230 can feed each sheet P to the second transfer roller 31 (to the aligning roller 32), using a second feed roller 231.

The paper sheet cassette 250 includes first to third springs 251, 252 and 253 provided therein for raising paper sheets P. These springs enable the conveyance in respective directions of paper sheets P contained in the paper sheet cassette 250, together with the first and second feed rollers 221 and 231 of the first and second conveyance systems 220 and 230. The feed rollers 221 and 231 may be formed integral with the paper sheet cassette 250 as one body. In this case, each of conveyance rollers located (usually in the conveyance systems) downstream of the feed rollers may be formed integral with the paper sheet cassette 250 as one body.

In this structure, the conveyance path of paper sheets P to the intermediate transfer member 9 when forming a color image can be shortened, and paper sheets P can be fed from the same paper sheet cassette when forming a color image and a black-and-white image.

Figure 4:
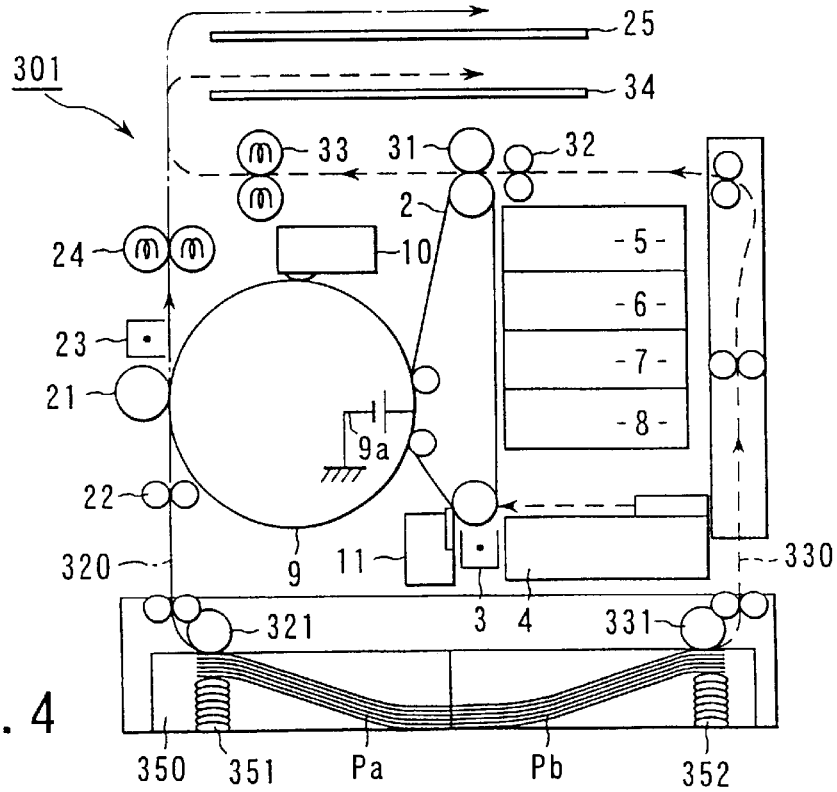
FIG. 4 is a schematic view illustrating a color image forming apparatus according to a further embodiment of the invention.

FIG. 4 is a schematic view illustrating a color image forming apparatus according to a further embodiment. In the color image forming apparatus of FIG. 4, similar elements to those in FIG. 1 are denoted by corresponding reference numerals, and no detailed description will be given thereof.

As shown in FIG. 4, a color image forming apparatus 301 has a photosensitive member 2, a charger 3, an exposing unit 4, first to fourth developing units 5, 6, 7 and 8, an intermediate transfer member 9, an image forming section 12 that includes an intermediate transfer member cleaner 10 and a cleaning unit 11, a first conveyance system 320, a second conveyance system 330 and a paper sheet cassette 350 that can contain two types of paper sheets.

The first conveyance system 320 includes a first feed roller 321 provided at the intermediate transfer member 9 side of the paper sheet cassette 350 for feeding each paper sheet P in group of paper sheets Pa, contained in one chamber 351 of the paper sheet cassette 350, toward the intermediate transfer member 9, and can supply the intermediate transfer member 9 with each paper sheet P through a short conveyance path.

The second conveyance system 330 is designed to convey each paper sheet P toward the second transfer roller 31 when forming a black-and-white image, and can feed each paper sheet P in the other group of paper sheets Pb, contained in the other chamber 352 of the paper sheet cassette 350, toward the transfer roller 31 (the aligning roller 32), using a second feed roller 331.

As described above, in the color image forming apparatus of FIG. 4, the paper sheet cassette 350 can simultaneously contain two types of group of paper sheets Pa and Pb. The group of paper sheets Pa and Pb contained therein can be supplied to the intermediate transfer member 9 and the photosensitive member 2 independently of each other by the first and second conveyance systems 320 and 330, respectively.

Figure 5:
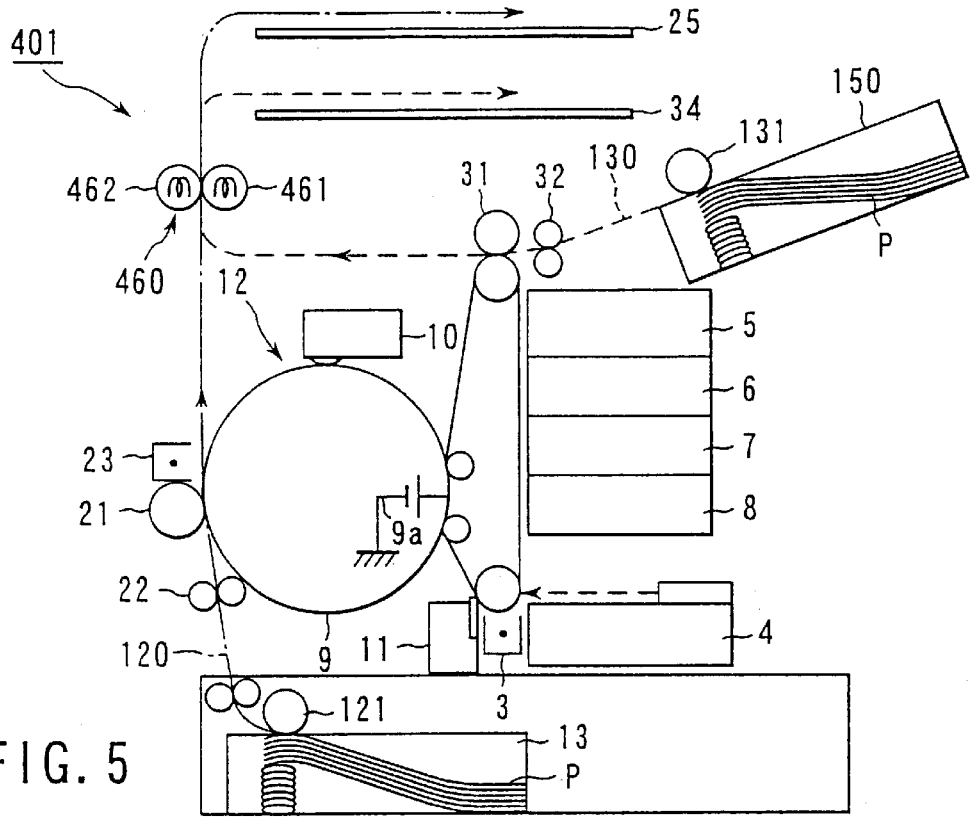
FIG. 5 is a schematic view illustrating a modification of the color image forming apparatus shown in FIG. 2.

FIG. 5 is a schematic view illustrating a color image forming apparatus according to a modification of the embodiment of FIG. 2. In the color image forming apparatus of FIG. 5, similar elements to those in FIG. 2 are denoted by corresponding reference numerals, and no detailed description will be given thereof.

As shown in FIG. 5, a color image forming apparatus 401 includes a photosensitive member 2, a charger 3, an exposing unit 4, first to fourth developing units 5, 6, 7 and 8, an intermediate transfer member 9, an image forming section 12 that includes an intermediate transfer member cleaner 10 and a cleaning unit 11, a first paper sheet cassette 13, a first conveyance system 120, a second conveyance system 130 and a second paper sheet cassette 150. The color image forming apparatus 401 of FIG. 5 employs only one fixing unit 460.

More specifically, as is evident from FIG. 5, the surface of a paper sheet P, onto which a color image formed on the intermediate transfer member 9 is transferred, and the surface of a paper sheet Pb, onto which a color image formed on the photosensitive member 2 is transferred, are brought into contact with the rollers 461 and 462 of the fixing unit 460, respectively. Accordingly, if one of the rollers 461 and 462 is formed of an elastic roller, it is possible that one of a color image and a black-and-white image will be insufficiently fixed, or the color reproductivity of a color image will fall out of an appropriate range. To avoid this, each of the rollers 461 and 462 has, for example, a hollow aluminum roller that has its outer peripheral surface coated with silicon rubber having a thickness of 4 mm, and a PFA tube with an outer diameter $\phi$ of 41 mm, which covers on the silicon rubber on the aluminum roller.

Figure 6:
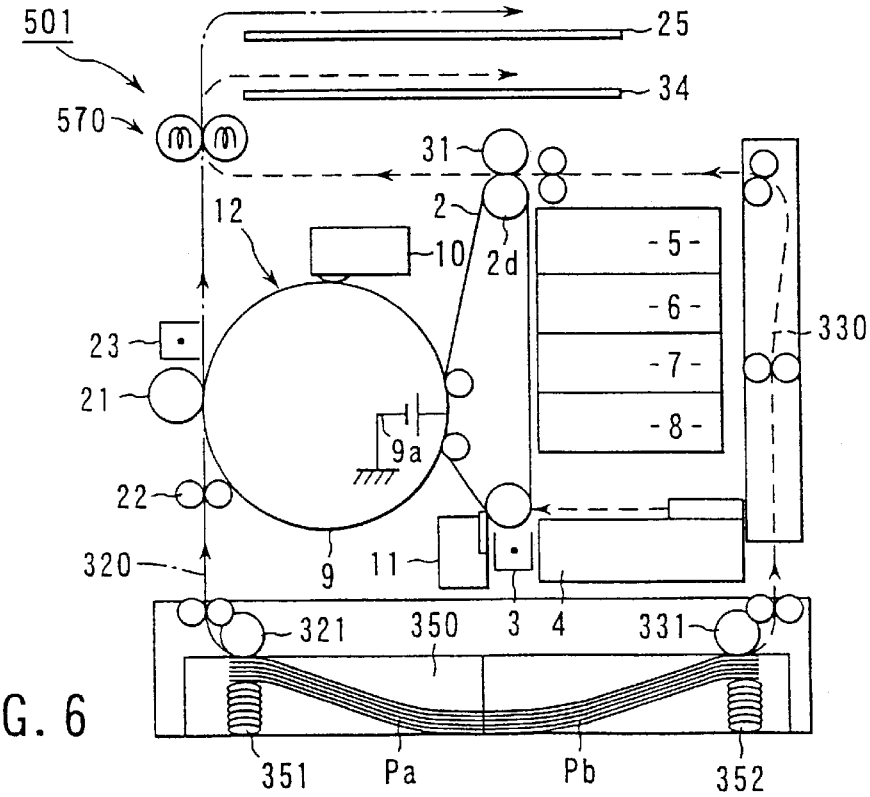
FIG. 6 is a schematic view illustrating a modification of the color image forming apparatus shown in FIG. 4.

FIG. 6 is a schematic view illustrating a color image forming apparatus according to a modification of the embodiment of FIG. 4. In the color image forming apparatus of FIG. 6, similar elements to those in FIG. 4 are denoted by corresponding reference numerals, and no detailed description will be given thereof.

As shown in FIG. 6, a color image forming apparatus 501 has a photosensitive member 2, a charger 3, an exposing unit 4, first to fourth developing units 5, 6, 7, and 8, an intermediate transfer member 9, an image forming section 12 that includes an intermediate transfer member cleaner 10 and a cleaning unit 11, a first conveyance system 320, a second conveyance system 330 and a paper sheet cassette 350 capable of containing two types of paper sheets. The color image forming apparatus 501 of FIG. 6 employs only one fixing unit 570.

Like the case of FIG. 4, the paper sheet cassette 350 in this modification can contain two types of group of paper sheets Pa and Pb (of the same size in FIG. 6). The sheets Pa and Pb are supplied to the intermediate transfer member 9 and the photosensitive member 2 independently of each other by the first and second conveyance systems 320 and 330, respectively.

The fixing unit 570 has substantially the same structure as the fixing unit 460 shown in FIG. 5.

A description will now be given of a special image forming operation (the operation of interrupting color image forming to execute black-and-white image forming) executed by the color image forming apparatuses shown in FIGS. 1 to 6.

For example, to interrupt the process of forming A4-size color images so as to form a black-and-white image, a series of characteristic operations as below are executed.

As aforementioned, the circumferential length of the intermediate transfer member 9 is twice or more the width of an A4 portrait size paper sheet. Accordingly, usually, two color images of A4 portrait size can be formed while the intermediate transfer member 9 makes rotates through 360 degrees (one revolution).

When forming an image on the entire paper sheet of A3 size, images of four colors having of a BK image, a Y image, an M image and a C image are sequentially transferred onto the intermediate transfer member 9 each time the body 9 rotates through 360 degrees. On the other hand, when forming an image of A4 portrait size, for example, a BK image included in one surface image of a double-sided document and a BK image included in the reverse surface of the document can be simultaneously output (transferred) onto the circumferential surface of the intermediate transfer member 9. After that, a Y image, an M image and a C image are sequentially transferred onto each BK image. This type of control enables reduction of the total time period required for forming a plurality of A4-size color images.

Figure 7A:
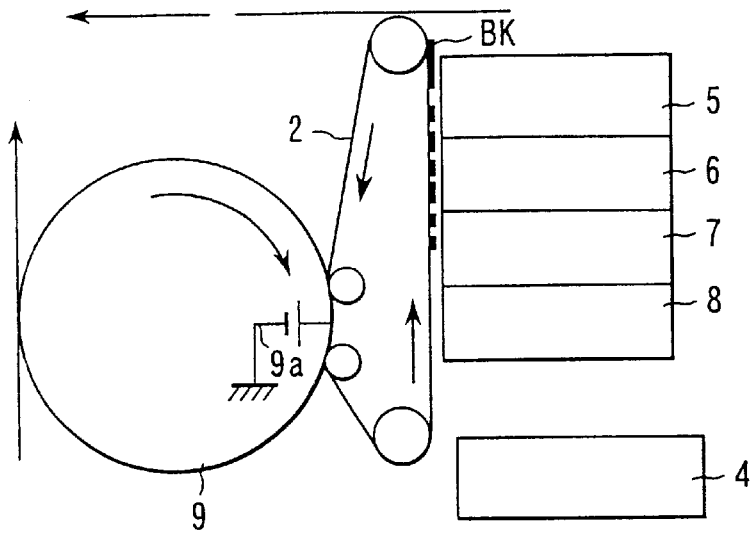
FIGS. 7A to 7J are views useful in explaining an example of a special operation executed by the image forming apparatus of each of FIGS. 1 to 6.
Figure 7B:
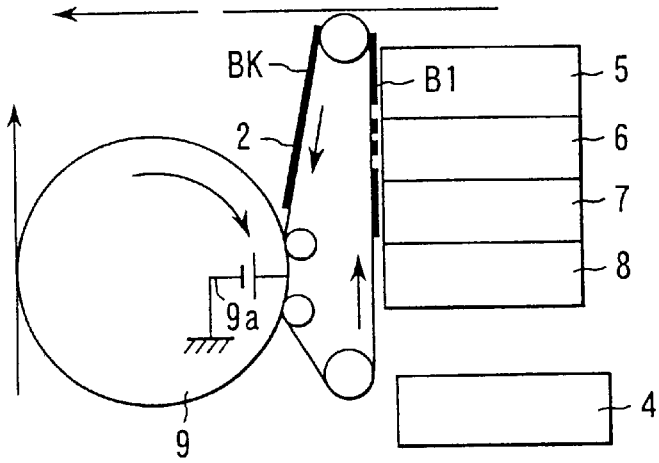

Using this function, a BK image included in a color image is formed on the photosensitive member 2 (FIG. 7A), and then an interrupting image (black-and-white image) B1 is formed thereon (FIG. 7B). In these two processes, the black developing unit 5 forms two toner images. Concerning a color image, suppose that a BK image, a Y image, an M image and a C image are formed in this order.

Figure 7C:
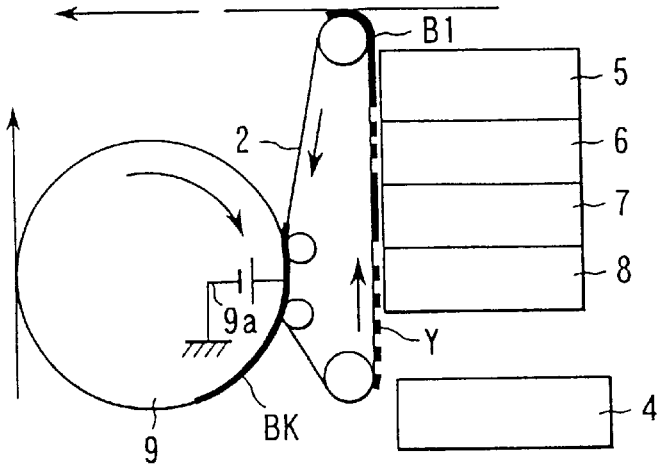

After that, a Y image included in the color image is formed on the photosensitive member 2 while the BK image formed on the photosensitive member 2 is transferred onto the intermediate transfer member 9 by voltage between the photosensitive member 2 and the intermediate transfer member 9 (FIG. 7C).

Figure 7D:
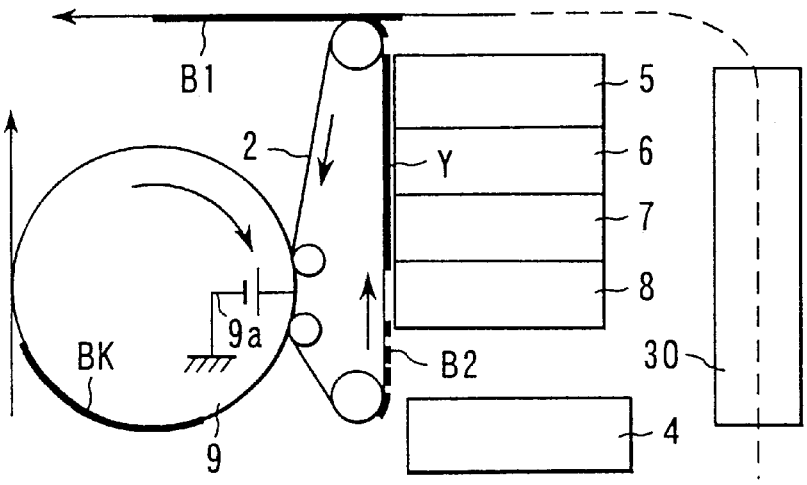

Subsequently, a second interrupting image (black-and-white image) B2 is formed on the photosensitive member 2 while the first black-and-white image B1 formed on the photosensitive member 2 is transferred, using the transfer roller 31, onto a paper sheet conveyed on the path 30 (130, 230, . . . 530) (FIG. 7D).

Figure 7E:
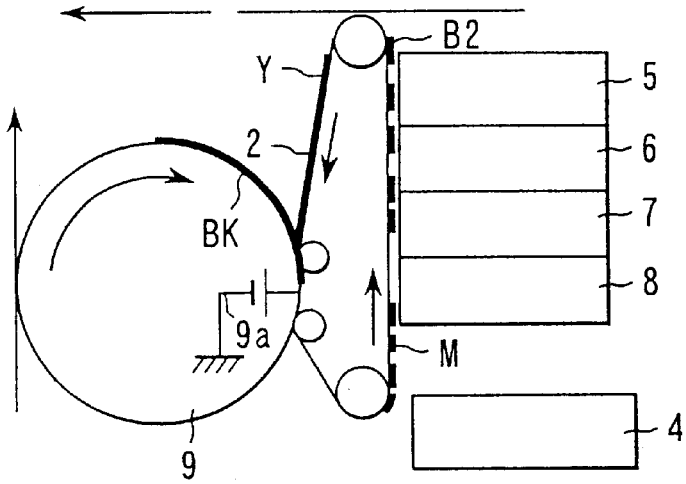

Similarly, an M image included in the color image is formed on the photosensitive member 2 while the Y image formed on the photosensitive member 2 is transferred onto the intermediate transfer member 9 such that it is superposed on the previously transferred BK image by voltage between the photosensitive member 2 and the intermediate transfer member 9 (FIG. 7E).

Figure 7F:
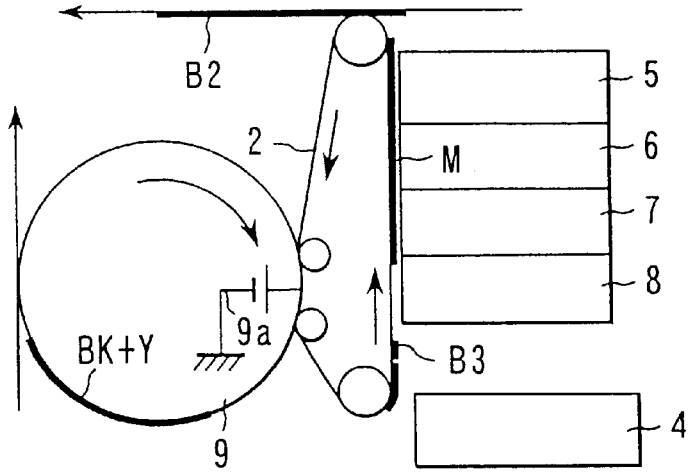

Subsequently, a third interrupting image (black-and-white image) B3 is formed on the photosensitive member 2 while the second black-and-white image B2 formed on the photosensitive member 2 is transferred, using the transfer roller 31, onto a paper sheet conveyed on the path 30 (130, 230, . . . 530) (FIG. 7F).

Figure 7G:
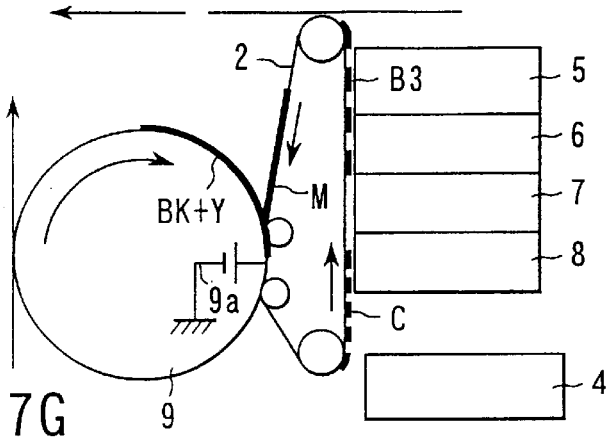

Similarly, a C image included in the color image is formed on the photosensitive member 2 while the M image formed on the photosensitive member 2 is transferred onto the intermediate transfer member 9 such that it is superposed upon the previously transferred BK and Y images by voltage between the photosensitive member 2 and the intermediate transfer member 9 (FIG. 7G).

Figure 7H:
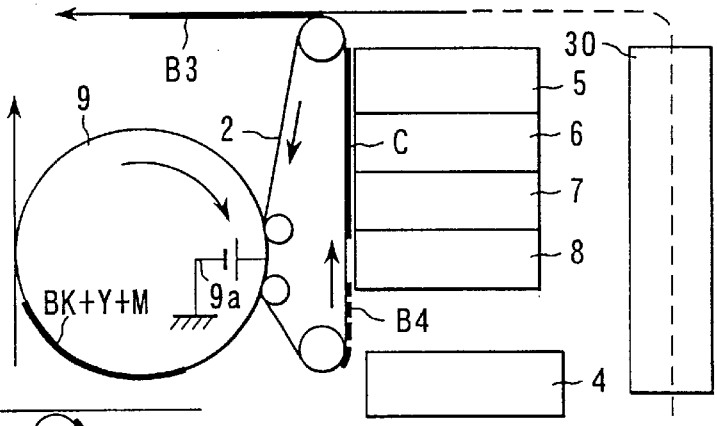

Thereafter, a fourth interrupting image (black-and-white image) B4 is formed on the photosensitive member 2 while the third black-and-white image B3 formed on the photosensitive member 2 is transferred, using the transfer roller 31, onto a paper sheet conveyed on the path 30 (130, 230, . . . 530) (FIG. 7H).

Figure 7I:
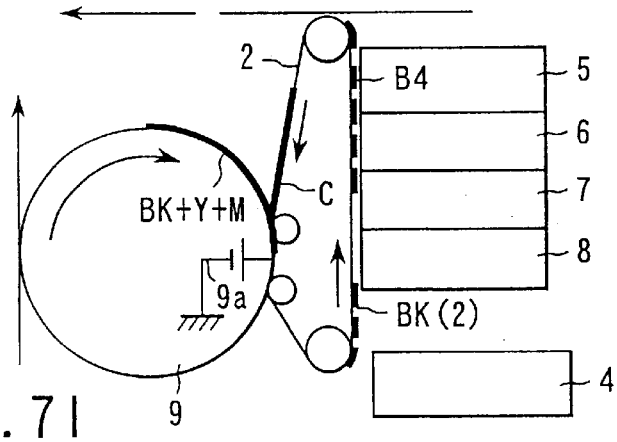

Then, a BK image included in the next color image is formed while the C image formed on the photosensitive member 2 is transferred onto the intermediate transfer member 9 such that it is superposed upon the previously transferred BK, Y and M images by voltage between the photosensitive member 2 and the intermediate transfer member 9 (FIG. 7I).

Figure 7J:
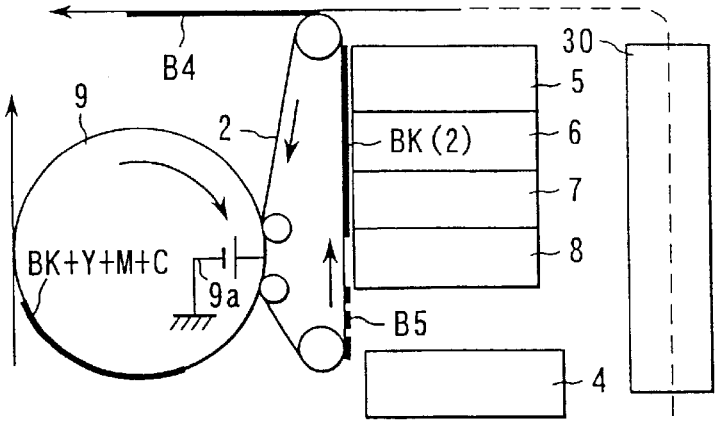

Thereafter, a fifth interrupting image (black-and-white image) B5 is formed on the photosensitive member 2 while the fourth black-and-white image B4 formed on the photosensitive member 2 is transferred, using the transfer roller 31, onto a paper sheet conveyed on the path 30 (130, 230, . . . 530) (FIG. 7J). If the next color image is not formed, the second BK image is not formed at the step shown in FIG. 7I. Further, where the number of interrupting images is less than 5, the operation of forming an interrupting image is finished before the step shown in FIG. 7J, 7H, 7F or 7D.

In other words, in the image forming operations shown in FIGS. 7A to 7J, at the first revolution of the intermediate transfer member 9, the BK image of a first color image and a non-output image corresponding to a first interrupting image (black-and-white image) are transferred onto the body 9. Since the interrupting image is directly transferred and output to a paper sheet from the photosensitive member 2 independently of a color image, the image corresponding to the interrupting image and transferred to the intermediate transfer member 9 is an offset image, which is not transferred to a paper sheet. The "non-output image" indicates this offset image. At the second revolution of the intermediate transfer member 9, the Y image of the first color image and a non-output image corresponding to a second interrupting image (black-and-white image) is transferred onto the body 9. At the third revolution of the intermediate transfer member 9, the M image of the first color image and a non-output image corresponding to a third interrupting image (black-and-white image) is transferred onto the body 9. At the fourth revolution of the intermediate transfer member 9, the C image of the first color image and a non-output image corresponding to a fourth interrupting image (black-and-white image) is transferred onto the body 9. At this point in time, the first color image is re-transferred from the intermediate transfer member 9 to a paper sheet, thereby forming a color image thereon.

Thus, interrupting images can be output independently by alternately forming, on the photosensitive member 2, each color component image included in a color image and each interrupting image, transferring each color component image onto the half of the circumferential surface of the intermediate transfer member 9, which is in the direction of rotation, and transferring each interrupting image onto the other half of the circumferential surface. Accordingly, the speed of forming a color image reduces to ½, but interrupting images can be continuously formed (copied) without stopping the color image forming operation.

Referring then to FIGS. 8A to 8M, a description will be given of another embodiment in which an A4-size monochrome document is copied interruptedly while an A4-size color image is copied.

For example, when a request for copying a black-and-white image has been issued while color images are continuously printed, a half of that image area of the intermediate transfer member 9, which is equal to the total area of two paper sheets of A4 portrait size, is assigned to black-and-white image copying.

Figure 8A:
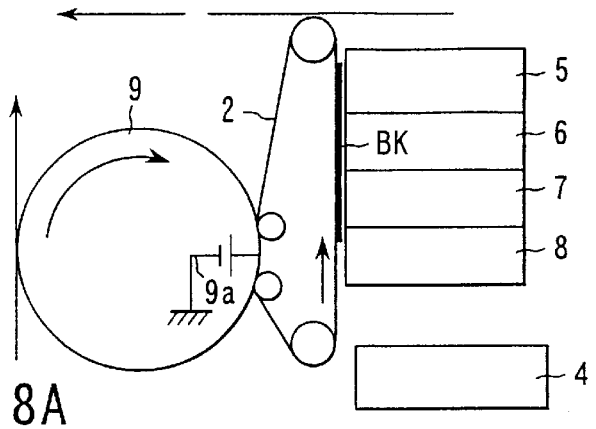
FIGS. 8A to 8M are views useful in explaining another special operation executed by the image forming apparatus of each of FIGS. 1 to 6.

First, the charger 3 uniformly charges the photosensitive member 2, and then the exposing unit 4 exposes the photosensitive member 2 to form thereon an electrostatic latent image corresponding to a BK image included in a color image. The developing unit (BK) 5 develops the latent image. (FIG. 8A)

Figure 8B:
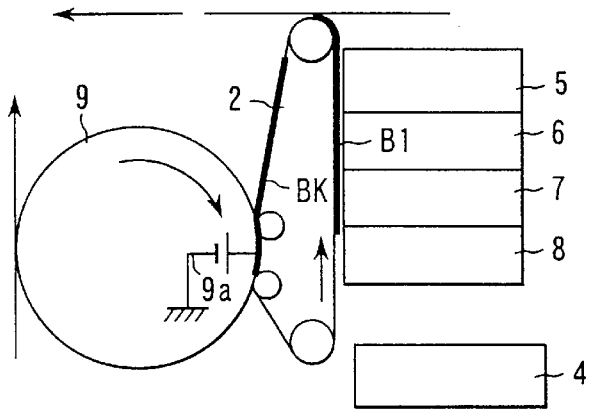

Subsequently, the exposing unit 4 exposes the photosensitive member 2 to form thereon an electrostatic latent image corresponding to a B1 image (a first interrupting image), and the BK developing unit 5 develops the latent image on the photosensitive member 2. The previously developed BK image is conveyed to an intermediate transfer position in which the intermediate transfer member 9 is in contact with the photosensitive member 2 by voltage between the photosensitive member 2 and the intermediate transfer member 9, without being transferred by the transfer roller 31. In the intermediate transfer position, the B1 image is transferred onto the intermediate transfer member 9. (FIG. 8B)

Figure 8C:
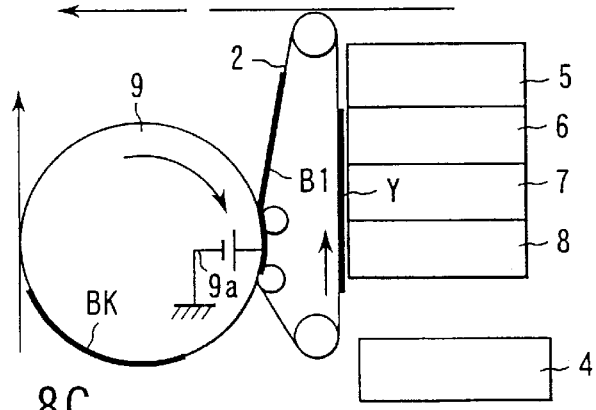
Figure 8D:
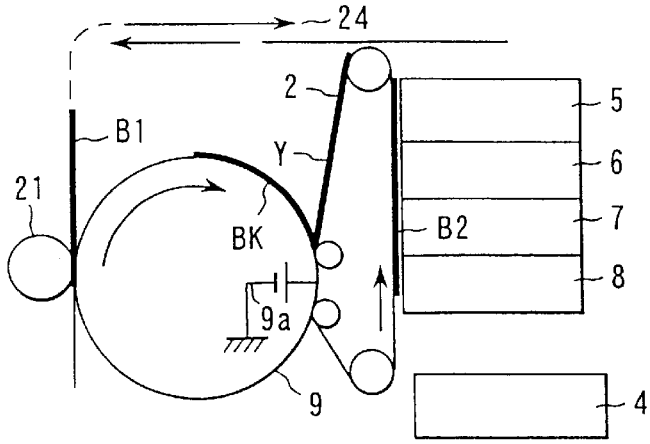

After that, the photosensitive member 2 is exposed to form thereon an electrostatic latent image corresponding to a Y image included in the color image, and the Y developing unit 6 develops the latent image, thereby obtaining a Y toner image. At this time, the B1 image is transferred onto the intermediate transfer member 9 downstream of the previously transferred BK image by voltage between the photosensitive member 2 and the intermediate transfer member 9 (FIG. 8C). In this state, the B1 toner image included in the color image is held on a color image area (situated at the upstream Bide of the intermediate transfer member 9), and the black toner (B1) image is held on a black-and-white image area situated downstream of the color image area.

Figure 8E:
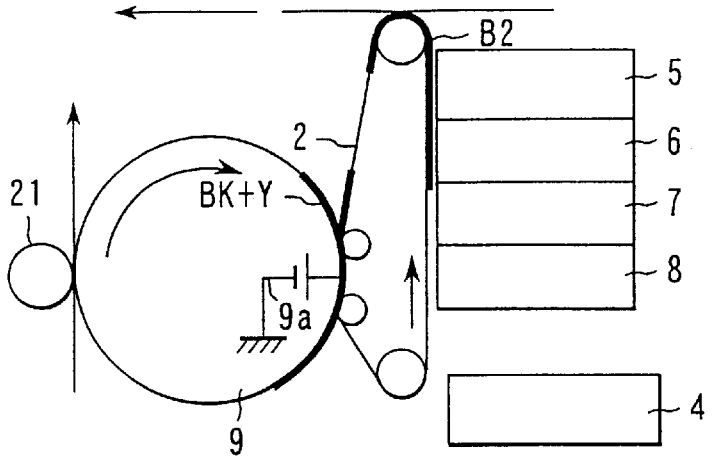

The black toner image (B1), which is a result of interrupting copying, is transferred onto a paper sheet P by the transfer roller 21 (FIG. 8D), and then fixed by the fixing unit 24. The paper sheet with the black toner image is guided, through a path selected by a tray switching mechanism (not shown), to, for example, the tray 34, to which black-and-white images are usually output. Accordingly, the B1 toner image (included in the color image) is left on the color image area of the intermediate transfer member 9. While the B1 toner image is left thereon, the photosensitive member 2 is exposed to form thereon an electrostatic latent image corresponding to a second interrupting black-and-white image B2, and the developing unit 5 develops the latent image, thereby forming a second black toner image B2 (FIG. 8E).

Figure 8F:
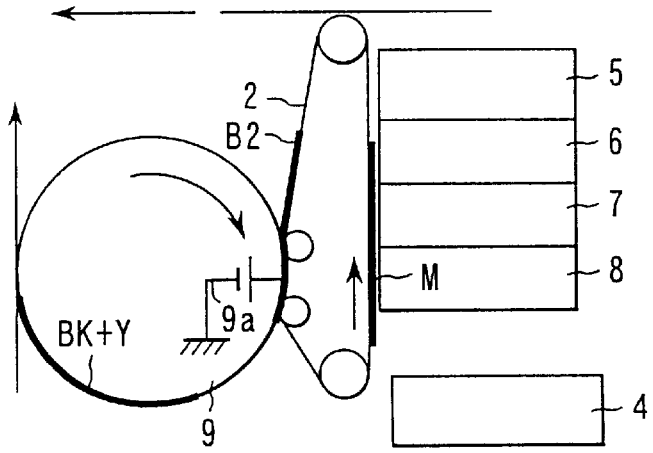

Subsequently, the photosensitive member 2 is exposed to form thereon an electrostatic latent image corresponding to an M image included in the color image, and the M developing unit 7 develops the latent image, thereby obtaining an M toner image. At this time, each of the Y toner image and the second black toner image B2 are transferred onto the intermediate transfer member 9 by voltage between the photosensitive member 2 and the intermediate transfer member 9, in series (FIG. 8F).

Figure 8G:
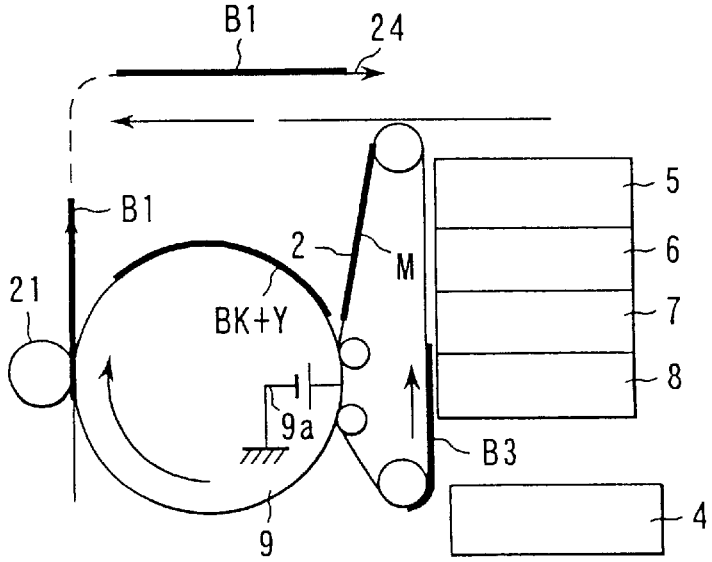
Figure 8H:
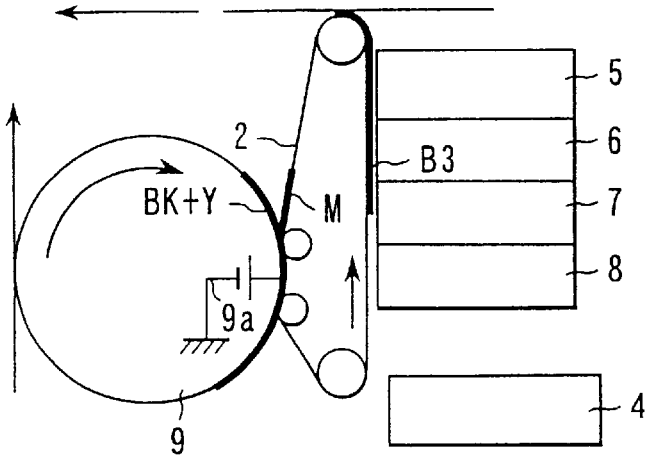

After that, the photosensitive member 2 is exposed to form thereon an electrostatic latent image corresponding to a third interrupting black-and-white image, and the developing unit 5 develops the latent image, thereby forming a third black toner image B3. While the third black toner image B3 is formed, the second black-and-white image B2 transferred to the intermediate transfer member 9 is further transferred onto a paper sheet by the transfer roller 21 and discharged (FIG. 8G). At the same time, the Y image is transferred onto the intermediate transfer member 9 such that it is superposed upon the BK image held thereon by voltage between the photosensitive member 2 and the intermediate transfer member 9 (FIG. 8H).

Figure 8I:
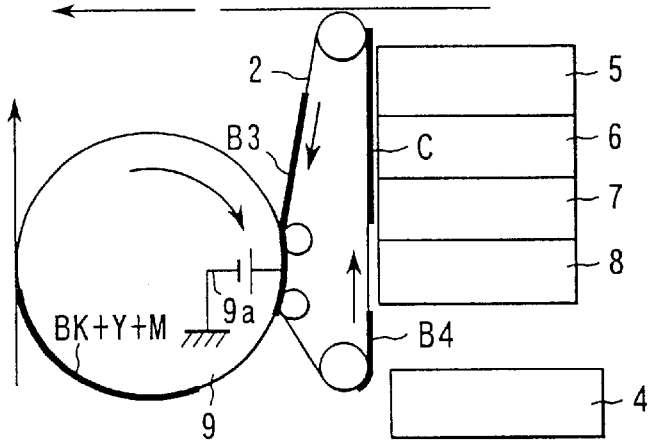

A latent image corresponding to a C image included in the color image is formed and developed in the same manner as above, and then a latent image corresponding to a fourth black-and-white image B4 is formed on the photosensitive member 2 (FIG. 8I).

Figure 8J:
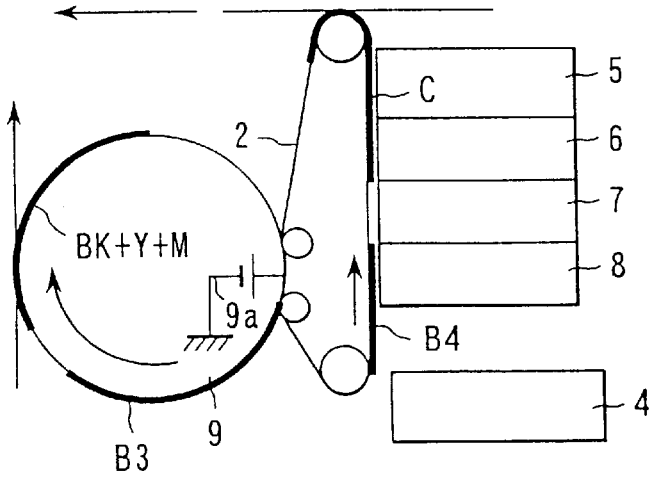

Thereafter, the M image is transferred onto the intermediate transfer member 9 such that it is superposed upon the BK image and the Y image previously transferred thereon, while the third black-and-white image B3 is transferred onto the remaining area of the intermediate transfer member 9 by voltage between the photosensitive member 2 and the intermediate transfer member 9 (FIG. 8J).

Then, the third black toner image B3 is transferred onto a paper sheet by the transfer roller 21 and sent to the fixing unit. At this time, a toner image consisting of the BK image, the Y image and the M image are superposed upon each other is left on the intermediate transfer member 9. In this state, a latent image corresponding to the BK image included in the next color image, if any, is formed on the photosensitive member 2 (FIG. 8K).

Then, the C image formed on the photosensitive member 2 is transferred onto the intermediate transfer member 9 such that it is superposed upon the BK image, the Y image and the M image previously transferred thereon, while the fourth black-and-white image B4 is transferred onto the remaining area of the intermediate transfer member 9 by voltage between the photosensitive member 2 and the intermediate transfer member 9. While the fourth black-and-white image B4 is transferred onto the intermediate transfer member 9, a color image formed by superposing the BK, Y, M and C toner images is transferred onto a paper sheet by the transfer roller 21 and sent to the fixing unit (FIG. 8L).

After that, the fourth black-and-white image B4 is transferred onto a paper sheet by the transfer roller 21 and sent to the fixing unit. At this time, if there is a fifth black-and-white image to be copied, a latent image corresponding to the fifth black-and-white image is formed on the photosensitive member 2 (FIG. 8M).

Figure 8K:
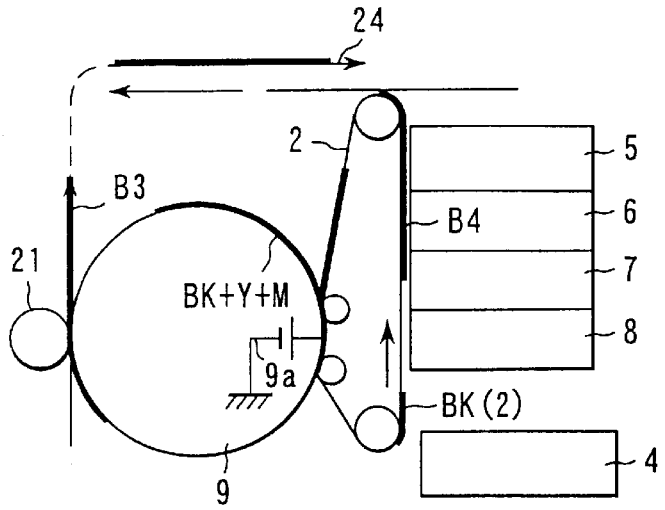
Figure 8L:
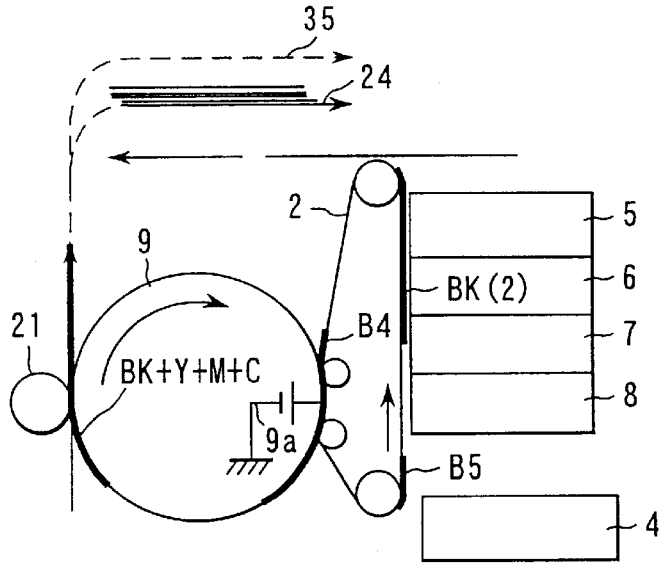
Figure 8M:
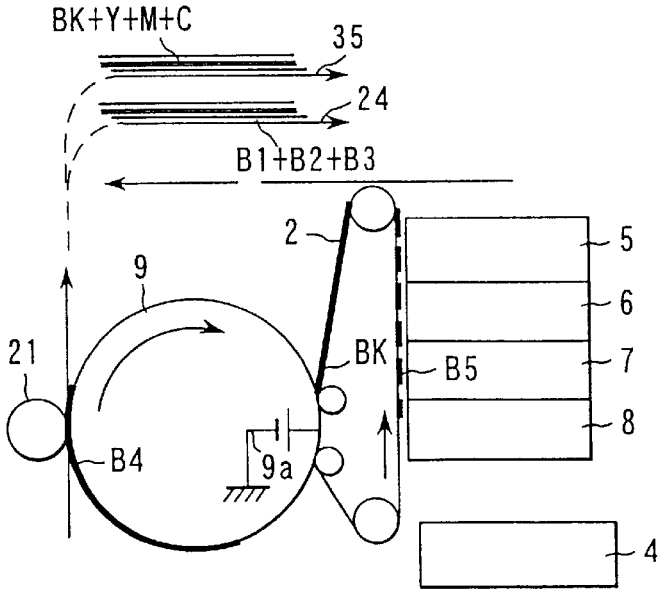

If there is no more color image to be copied, the next BK image is not formed in the state shown in FIG. 8K. Further, if the number of interrupting images is less than 5, the operation of forming an interrupting image is finished before the step shown in FIG. 8L, 8J, . . . , or 8D.

Each paper sheet, onto which a four-color toner image has been transferred, is sent to the fixing unit 24, where the toner image is fixed thereon. Each paper sheet with a color toner image fixed thereon is guided to the tray 25 through a path selected by a tray switching mechanism (not shown).

On the other hand, each paper sheet, onto which a black toner image has been transferred, is sent to the fixing unit 24, where the toner image is fixed thereon. Each paper sheet with a black toner image fixed thereon is guided to the tray 34 through a path selected by the tray switching mechanism.

Thus, one black-and-white image can be output each time the intermediate transfer member 9 makes one revolution, and one color image can be output each time the intermediate transfer member 9 makes four revolutions.

Accordingly, when, for example, forming two copies of a black-and-white image while forming two copies of a color image, the above control enables formation of a black-and-white image while forming a color image each time the intermediate transfer member 9 makes two revolutions. This control method also enables formation of a color image and a black-and-white image in a single paper sheet.

As described above, in the image forming apparatus of the invention, the process of transferring a color image onto a paper sheet is separated from the process of transferring a black-and-white image onto a paper sheet, thereby enabling transfer of a black-and-white image onto a paper sheet and fixing of the transferred black-and-white image immediately after development. As a result, the first copying period of a black-and-white image can be shortened.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color image forming apparatus comprising:

a charger unit for charging a photosensitive member;

an exposing unit for forming an electrostatic latent image on the charged photosensitive member;

a developing unit for visualizing the electrostatic latent image formed on the photosensitive member to form a toner image;

a first transfer unit for directly transferring the toner image on the photosensitive member onto an image receiving material;

a second transfer unit including an intermediate transfer member for transferring the toner image, formed on the photosensitive member, onto the intermediate transfer member, and for transferring the toner image, transferred to the intermediate transfer member, onto the image receiving material; and a fixing unit for fixing the toner image on the image receiving material transferred to the image receiving material by the first and second transfer units and held thereon, wherein the first transfer unit transfers only a black-and-white image onto the image receiving material, and the toner image is transferred on the toner image receiving material at a position different from where the photosensitive member and the intermediate transfer member intersect with each other.

2. The image forming apparatus according to claim 1, wherein the second transfer unit transfers only a color image onto the image receiving material.

3. The image forming apparatus according to claim 1, further comprising:

a first path for guiding the image receiving material between the fixing unit and the first transfer unit;

a second path for guiding the image receiving material between the fixing unit and the second transfer unit; and a path confluence at which the first and second paths gather.

4. The image forming apparatus according to claim 3, further comprising:

a first image receiving material supply mechanism for supplying the image receiving material to the first transfer unit along a first route; and a second image receiving material supply mechanism for supplying the image receiving material to the second transfer unit along a second route different from the first route.

5. The image forming apparatus according to claim 1, further comprising:

a first image receiving material supply mechanism for supplying the image receiving material to the first transfer unit along a first route; and a second image receiving material supply mechanism for supplying the image receiving material to the second transfer unit along a second route different from the first route.

6. The image forming apparatus according to claim 1, further comprising:

an image receiving material supply mechanism capable of conveying the image receiving material both in a first direction and in a second direction opposite to the first direction, and wherein the image receiving material supply mechanism supplies the image receiving material to the first transfer unit in the first direction, and to the second transfer unit in the second direction.

7. The image forming apparatus according to claim 6, wherein where the image receiving material supply mechanism is divided into first and second chambers, from which the image receiving material can be conveyed in the first and second directions, respectively, the image receiving material is supplied to the first and second transfer units in the first and second directions, respectively.

8. A color image forming method in a color image forming apparatus includes a charger unit for charging a photosensitive member; an exposing unit for an electrostatic latent image on the charged photosensitive member charged by the charger unit; a developing unit for visualizing the electrostatic latent image formed on the photosensitive member to formed toner image; an intermediate transfer member for holding the toner image formed on the photosensitive member; a first transfer unit for transferring the toner image on the photosensitive member; a second transfer unit for transferring the toner image on the intermediate transfer member; and a fixing unit for fixing the toner image on an image receiving material comprising steps of:

forming a first image on the photosensitive member;

forming a second image on the photosensitive member;

directly transferring the first image on the image receiving material by using the first transfer unit;

transferring the second image on the intermediate transfer member; and transferring the transferred second image on an image receiving material by using the second transfer unit, wherein the first transfer unit transfers only a black-and-white image onto the image receiving material, and the toner image is transferred at the toner image receiving material at a position different from where the photosensitive member and the intermediate transfer member intersect with each other.

9. An image forming method according to claim 8, employed when a request has been issued for simultaneously forming the first image of a first group images and a color image as the second image of a second group images, each of the images having a length equal to about ½ a predetermined length, comprising the steps of:

sequentially forming, on the photosensitive member, an image having a length equal to about ½ the predetermined length and serving as a first color component of the second group images, and a first one of the first group images having a length equal to about ½ the predetermined length;

directly transferring the first one of the first group images onto a sheet of the image receiving material, using the first transfer unit;

transferring the image as the first color component of the second group images onto the intermediate transfer member by the voltage between the photosensitive member and the intermediate transfer member;

sequentially forming, on the photosensitive member, an image having a length equal to about ½ the predetermined length and serving as a second color component of the second group images, and a second one of the first group images having a length equal to about ½ the predetermined length;

directly transferring the second one of the first group images onto another sheet of the image receiving material, using the first transfer unit;

transferring the image as the second color component of the second group images onto the intermediate transfer member by voltage between the photosensitive member and the intermediate transfer member such that it is superposed upon the previously transferred image as the first color component; and simultaneously transferring, onto yet another sheet of the image receiving material, the superposed images as the first and second color components of the second group images on the intermediate transfer member of the second transfer unit.

10. An image forming method according to claim 9, the predetermined length is slightly shorter than the length of the outer peripheral intermediate member.

11. An image forming method according to claim 10, each of the first image receiving material supply mechanism and the second image receiving material supply mechanism are formed within an one cavity.

12. An image forming method according to claim 11, the cavity capable of delivering each of the image receiving materials toward the first transfer unit and the second transfer unit.

13. An image forming method according to claim 8, wherein the first transfer unit transfers only the first image of the first group of images onto the image receiving material.

14. An image forming method according to claim 13, the image receiving material transferred the each of the first image of the first group images is supplied from first path for guiding the image receiving material to the first transfer unit.

15. An image forming method according to claim 8, the second transfer unit transfers only a second image of a second group of images onto the image receiving material.

16. An image forming method according to claim 15, the image receiving material transferred each of the color components of the second group images is supplied from second path for guiding the image receiving material to the second transfer unit.

17. An image forming method according to claim 8, a first image receiving material supply mechanism for supplying an image receiving material to the first transfer unit along first route; a second image receiving material supply mechanism for supplying an image receiving material to the second transfer unit along second route different from the first route.

18. A color image forming method in a color image forming apparatus including a charger unit for charging a photosensitive member, an exposing unit for an electrostatic latent image on the charged photosensitive member charged by the charger unit, a developing unit for visualizing the electrostatic latent image formed on the photosensitive member to form a toner image, and intermediate transfer member for holding the toner image formed on the photosensitive member, a transfer unit for transferring the toner image on the intermediate transfer member, and a fixing unit for fixing the toner image on an image receiving material, said method being employed when a request has been issued for simultaneously forming the first image of first group images and a color image as the second image of second group images, each of the images having a length equal to about ½ a predetermined length, comprising the steps of:

sequentially forming, on the photosensitive member, an image having a length equal to about ½ the predetermined length and serving as a first color component of the second group images, and a first one of the first group images having a length equal to about ½ the predetermined length;

temporarily transferring, onto the intermediate transfer member, the image as the first color component the second group images and the first one of the first groups images;

transferring the first one of the first group images onto a sheet of the image receiving material, and discharging the sheet of the image receiving material;

sequentially forming, on the photosensitive member, an image having a length equal to about ½ the predetermined length and serving as a second color component of the second group images, and a second one of the first group images having a length equal to about ½ the predetermined length, while keeping the image as the first color component on the intermediate transfer member;

temporarily transferring, onto the intermediate transfer member, the image as the second color component of the second group images and the second one of the first group images, such that the image as the second color component is superposed upon the image as the first color component previously transferred on the intermediate transfer member, and the second one of the first group images is situated in an area of the intermediate transfer member, in which no image exists;

transferring the second one of the first group images onto another sheet of the image receiving material, and discharging said another sheet of the image receiving material; and simultaneously transferring, onto yet another sheet of the image receiving material, the superposed images as the first and second color components of the second group images on the intermediate transfer member.

19. An image forming method according to claim 18, the predetermined length is slightly shorter than the length of the outer peripheral intermediate member.

* * * * *